US009711337B2

(12) United States Patent
Green et al.

(10) Patent No.: US 9,711,337 B2
(45) Date of Patent: Jul. 18, 2017

(54) DATA DEPENDENT CONTROL OF THE INTENSITY OF IONS SEPARATED IN MULTIPLE DIMENSIONS

(71) Applicant: Micromass UK Limited, Wilmslow (GB)

(72) Inventors: Martin Raymond Green, Bowdon (GB); Keith Richardson, Derbyshire (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/774,981

(22) PCT Filed: Mar. 14, 2014

(86) PCT No.: PCT/GB2014/050775

§ 371 (c)(1),
(2) Date: Sep. 11, 2015

(87) PCT Pub. No.: WO2014/140601

PCT Pub. Date: Sep. 18, 2014

(65) Prior Publication Data

US 2016/0035551 A1 Feb. 4, 2016

(30) Foreign Application Priority Data

Mar. 14, 2013 (EP) ..... 13159164
Mar. 14, 2013 (GB) ..... 1304583.6

(51) Int. Cl.
*H01J 49/00* (2006.01)
*H01J 49/40* (2006.01)
*H01J 49/42* (2006.01)

(52) U.S. Cl.
CPC ..... *H01J 49/0036* (2013.01); *H01J 49/0031* (2013.01); *H01J 49/40* (2013.01); *H01J 49/4215* (2013.01)

(58) Field of Classification Search
USPC ..... 250/281, 282
See application file for complete search history.

(56) References Cited

U.S. PATENT DOCUMENTS 7,047,144 B2 5/2006 Steiner
7,238,936 B2 7/2007 Okamura et al.
(Continued)

*Primary Examiner* — Nicole Ippolito
*Assistant Examiner* — Hanway Chang
(74) *Attorney, Agent, or Firm* — Diederiks & Whitelaw, PLC

(57) ABSTRACT

A method of mass spectrometry is disclosed comprising setting an attenuation factor of an attenuation device to a first value and then separating or filtering ions according to a first physico-chemical property and separating or filtering ions according to a second physico-chemical property and obtaining a multi-dimensional array of data. The most intense ion peak within one or more subsets of the multi-dimensional array of data is determined. If it is determined that the most intense ion peak would cause saturation of an ion detector or ion detection system then the method further comprises adjusting the attenuation factor of the attenuation device to a second value and obtaining mass spectral data wherein the adjustment of the attenuation factor substantially alters the intensity of all ions which are detected by the ion detector or ion detection system equally and irrespective of the mass to charge ratio of the ions. The intensity of the mass spectral data is then scaled based upon the degree to which the attenuation factor of the attenuation device was increased or reduced.

28 Claims, 7 Drawing Sheets

(56) References Cited

U.S. PATENT DOCUMENTS

| | | | | |
|---|---|---|---|---|
| 7,683,314 | B2 | 3/2010 | Green et al. | |
| 9,129,781 | B2 * | 9/2015 | Richardson ..... | H01J 49/0027 |
| 2010/0108879 | A1 | 5/2010 | Bateman et al. | |
| 2014/0291504 | A1 | 10/2014 | Richarson et al. | |

* cited by examiner

DATA DEPENDENT CONTROL OF THE INTENSITY OF IONS SEPARATED IN MULTIPLE DIMENSIONS

CROSS-REFERENCE TO RELATED APPLICATION

This application is the National Stage of International Application No. PCT/GB2014/050775, filed 14 Mar. 2014 which claims priority from and the benefit of United Kingdom patent application No. 1304583.6 filed on 14 Mar. 2013 and European patent application No. 13159164.6 filed 14 Mar. 2013. The entire contents of these applications are incorporated herein by reference.

BACKGROUND OF THE PRESENT INVENTION

The present invention relates to a method of mass spectrometry and a mass spectrometer.

In many applications very complex mixtures of compounds are analysed. Individual components within these mixtures are present with a wide range of relative concentrations and may be in the presence of large concentrations of matrix or endogenous background signals. This gives rise to a wide range of ion current intensities which are transmitted to the mass analyser and the ion detector. For many applications it is important to produce quantitative and qualitative data (in the form of exact mass measurement) for as many specific target analytes as possible. This puts very high demands on the dynamic range of the ion source, the mass analyser and the ion detection system employed in the mass spectrometer.

It is known that the addition of ion mobility separation to a mass spectrometer results in a concentration of the ion signal as ions from a particular analyte are delivered to the ion detector in a short period of time compared to the total ion mobility separation time. This ion concentration effect puts high demand on the ion detector and ADC recording system resulting in a reduced dynamic range.

A known method of controlling the intensity of a signal is to adjust the transmission or sensitivity of the mass spectrometer or the gain of an electron multiplier to keep the most intense species of ion within a specific mass to charge ratio range within the dynamic range of the ion detection system. This may be the base peak within a whole spectrum or a specific mass to charge ratio value in a targeted analysis. In this case it may not matter that signals from other mass to charge ratio values exceed the dynamic range of the detection system as long as they are separated from the target of interest.

U.S. Pat. No. 7,047,144 and U.S. Pat. No. 7,238,936 disclose methods of adjusting the gain of an ion detector based upon the intensity of the largest peak within a defined mass to charge ratio value. This known method of adjusting the gain is particularly prone to errors due to interference of background ions.

GB-2489110 (Micromass) discloses with reference to FIG. 2 an arrangement comprising an ion mobility separation device, an attenuation device and a Time of Flight mass analyser. Ions are subjected to a two dimensional separation and ions having a particular ion mobility and a particular mass to charge ratio are selectively attenuated.

US 2010/108879 (Micromass) discloses an arrangement comprising an ion mobility spectrometer and an ion gate. The operation of the ion mobility spectrometer and ion gate are synchronised so that only ions having a particular mass to charge ratio and a desired charge state are onwardly transmitted to a collision cell.

US 2006/020400 (Okamura) discloses a detector assembly having a current measuring device with a saturation threshold level.

GB-2502650 (Micromass) discloses selectively attenuating abundant or intense species of ions in a population of ions.

It is desired to provide an improved mass spectrometer and method of mass spectrometry.

SUMMARY OF THE PRESENT INVENTION

According to an aspect of the present invention there is provided a method of mass spectrometry comprising:

setting an ionisation efficiency of an ion source to a first value and/or setting an attenuation factor of an attenuation device to a first value and/or setting a gain of an ion detector or ion detection system to a first value; and then separating or filtering ions according to a first physico-chemical property and separating or filtering ions according to a second physico-chemical property and obtaining a multi-dimensional array of data;

determining the most intense ion peak within one or more subsets of the multi-dimensional array of data; and determining whether or not the most intense ion peak would cause saturation of an ion detector or an ion detection system or would otherwise adversely affect the operation of the ion detector or ion detection system;

wherein if it is determined that the most intense ion peak would cause saturation of the ion detector or ion detection system or would otherwise adversely affect the operation of the ion detector or ion detection system then the method further comprises:

(i) adjusting the ionisation efficiency of the ion source to a second value and/or adjusting the attenuation factor of the attenuation device to a second value and/or adjusting the gain of the ion detector or ion detection system to a second value;

(ii) obtaining mass spectral data wherein the adjustment of the ionisation efficiency of the ion source and/or the adjustment of the attenuation factor of the attenuation device and/or the adjustment of the gain of the ion detector or ion detection system alters the intensity of substantially all ions which are detected by the ion detector or ion detection system substantially equally and substantially irrespective of the mass to charge ratio of the ions; and then (iii) scaling the intensity of the mass spectral data based upon the degree to which the ionisation efficiency of the ion source and/or the attenuation factor of the attenuation device and/or the gain of the ion detector or ion detection system was increased or reduced.

The present invention improves on known methods of extending the dynamic range of a mass spectrometer and in particular the ion detection system of a mass spectrometer.

According to the preferred embodiment two dimensional nested data is preferably produced by, for example, separating ions according to their ion mobility using an ion mobility spectrometer ("IMS") prior to mass analysis.

The present invention allows more accurate control of the intensity of an analyte. This is achieved by targeting the analyte after separation by more than one dimension of separation (as opposed to targeting the analyte based solely on separation by mass to charge ratio in the case of conventional methods).

The method according to the preferred embodiment reduces the likelihood of over-attenuating analyte ions of interest due to interference from a large un-resolved background ion within the same target window.

The present invention also allows chemically similar analytes to be targeted by allowing targeting based upon correlation between more than one dimension of separation.

In the preferred embodiment target ions are selected by restricting both the mass to charge ratio range and the ion mobility drift time ("DT") range characteristic of the analyte or analytes. Only those signals within predetermined multi dimensional arrays of data are controlled such that their intensity is adjusted to be within the limits of the dynamic range of the ion detection system.

The preferred embodiment ensures a greater likelihood that the correct value of signal attenuation is applied for each target species. For example, in a system without ion mobility separation an isobaric or nominally isobaric interference may elute at substantially the same retention time ("RT"). According to the conventional approach the attenuation device would ensure that the largest of the two signals was within the dynamic range of the ion detection system. However, the largest signal may in fact comprise an interference ion and as a result the attenuation device will cause unnecessary attenuation of the analyte ions.

According to the preferred embodiment the addition of ion mobility separation enables the two signals to be separated and allows the correct attenuation factor to be applied based upon both the mass to charge ratio and the drift time ("DT") of the target or analyte ions.

Specific groups of analytes such as pesticides or lipids may elute within a characteristic mass to charge ratio and/or drift time ("DT") region.

The data dependent attenuation method according to the preferred embodiment may be targeted to keep any ion signal appearing within this region within the dynamic range of the mass spectrometer. The method according to the preferred embodiment can exclude background matrix ions from dominating the calculation of attenuation required.

This is not possible using conventional methods.

It is known that species with the same mass to charge ratio but different charge states lie in distinct separated bands within a two dimensional ion mobility-mass to charge ratio array. By choosing a target area within this array such that singly charged ions are substantially excluded intensity control may be made to act only on multiply charged ions. In this case the mass to charge ratio window may be a function of the ion mobility drift time allowing any region or multiple regions of the separation space to be targeted for data dependent attenuation. This provides a simple semi-targeted dynamic intensity correction.

The method according to the preferred embodiment may be extended such that the intensity of target species used to control the attenuation method may be monitored not only within a specific mass to charge ratio range but also within a specific chromatographic retention time ("RT") range and/or ion mobility drift time ("DT") range.

For example, if the chromatographic retention time window of a target analyte is known, a series of three dimensional arrays may be determined for each analyte. Each array may consist of a retention time window, a mass to charge ratio window and a drift time window. The windows in each any dimension may be a function of one or more of the other dimensions of separation proving a high degree of flexibility and specificity not available according to conventional approaches.

GB-2489110 (Micromass) discloses subjecting ions to a two dimensional separation and attenuate specific ions having a particular ion mobility and a particular mass to charge ratio. GB-2489110 (Micromass) does not disclose adjusting the attenuation factor of an attenuation device so as to alter the intensity of substantially all ions which are detected by the ion detector or ion detection system equally and irrespective of the mass to charge ratio of the ions.

US 2010/108879 (Micromass) is concerned with the problem of removing singly charged background ions and is not concerned with the problem of avoiding saturation of an ion detector or ion detection system.

The first physico-chemical property preferably comprises ion mobility or differential ion mobility.

The second physico-chemical property preferably comprises mass, mass to charge ratio or time of flight.

The first and/or the second physico-chemical property may comprise mass, mass to charge ratio, time of flight, ion mobility, differential ion mobility, retention time, liquid chromatography retention time, gas chromatography retention time or capillary electrophoresis retention time.

The step of adjusting an attenuation factor of an attenuation device preferably comprises repeatedly switching an attenuation device between a first mode of operation for a time period $\Delta T_1$ wherein the ion transmission is substantially 0% and a second mode of operation for a time period $\Delta T_2$ wherein the ion transmission is >0%.

The step of adjusting the attenuation factor of the attenuation device preferably comprises adjusting the mark space ratio $\Delta T_2/\Delta T_1$ in order to adjust or vary the transmission or attenuation of the attenuation device.

The method preferably further comprises switching between the first mode of operation and the second mode of operation with a frequency of: (i) <1 Hz; (ii) 1-10 Hz; (iii) 10-50 Hz; (iv) 50-100 Hz; (v) 100-200 Hz; (vi) 200-300 Hz; (vii) 300-400 Hz; (viii) 400-500 Hz; (ix) 500-600 Hz; (x) 600-700 Hz; (xi) 700-800 Hz; (xii) 800-900 Hz; (xiii) 900-1000 Hz; (xiv) 1-2 kHz; (xv) 2-3 kHz; (xvi) 3-4 kHz; (xvii) 4-5 kHz; (xviii) 5-6 kHz; (xix) 6-7 kHz; (xx) 7-8 kHz; (xxi) 8-9 kHz; (xxii) 9-10 kHz; (xxiii) 10-15 kHz; (xxiv) 15-20 kHz; (xxv) 20-25 kHz; (xxvi) 25-30 kHz; (xxvii) 30-35 kHz; (xxviii) 35-40 kHz; (xxix) 40-45 kHz; (xxx) 45-50 kHz; and (xxxi) >50 kHz.

According to an embodiment $\Delta T_1 > \Delta T_2$. According to another embodiment $\Delta T_1 \leq \Delta T_2$.

The time period $\Delta T_1$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

The time period $\Delta T_2$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

The attenuation device preferably comprises one or more electrostatic lenses.

In the first mode of operation a voltage is preferably applied to one or more electrodes of the attenuation device, wherein the voltage causes an electric field to be generated which acts to retard and/or deflect and/or reflect and/or divert a beam of ions.

The step of adjusting the attenuation factor of the attenuation device preferably comprises controlling the intensity of ions which are onwardly transmitted by the attenuation device by repeatedly switching the attenuation device ON and OFF, wherein the duty cycle of the attenuation device may be varied in order to control the degree of attenuation of the ions.

According to another aspect of the present invention there is provided a mass spectrometer comprising:

a first device for separating or filtering ions according to a first physico-chemical property;

a second device for separating or filtering ions according to a second physico-chemical property;

an ion detector or ion detection system; and a control system arranged and adapted:

(i) to set an ionisation efficiency of an ion source to a first value and/or to set an attenuation factor of an attenuation device to a first value and/or to set a gain of the ion detector or ion detection system to a first value; and then (ii) to cause ions to separate or be filtered according to the first physico-chemical property in the first device and to cause ions to separate or be filtered according to the second physico-chemical property and to obtain a multi-dimensional array of data;

(iii) to determine the most intense ion peak within one or more subsets of the multi-dimensional array of data; and (iv) to determine whether or not the most intense ion peak would cause saturation of the ion detector or the ion detection system or would otherwise adversely affect the operation of the ion detector or ion detection system;

wherein if it is determined that the most intense ion peak would cause saturation of the ion detector or ion detection system or would otherwise adversely affect the operation of the ion detector or ion detection system then the control system is further arranged and adapted:

(v) to adjust the ionisation efficiency of the ion source to a second value and/or to adjust the attenuation factor of the attenuation device to a second value and/or to adjust the gain of the ion detector or ion detection system to a second value;

(vi) to obtain mass spectral data wherein the adjustment of the ionisation efficiency of the ion source and/or the adjustment of the attenuation factor of the attenuation device and/or the adjustment of the gain of the ion detector or ion detection system alters the intensity of substantially all ions which are detected by the ion detector or ion detection system substantially equally and substantially irrespective of the mass to charge ratio of the ions; and then (vii) to scale the intensity of the mass spectral data based upon the degree to which the ionisation efficiency of the ion source and/or the attenuation factor of the attenuation device and/or the gain of the ion detector or ion detection system was increased or reduced.

The first device preferably comprises an ion mobility or differential ion mobility separator or filter.

The second device preferably comprises a mass, mass to charge ratio or time of flight separator or filter.

The first and/or the second device may comprise a mass, mass to charge ratio, time of flight, ion mobility, differential ion mobility, retention time, liquid chromatography retention time, gas chromatography retention time or capillary electrophoresis retention time separator or filter.

The control system is preferably arranged and adapted to adjust an attenuation factor of the attenuation device by repeatedly switching the attenuation device between a first mode of operation for a time period $\Delta T_1$ wherein the ion transmission is substantially 0% and a second mode of operation for a time period $\Delta T_2$ wherein the ion transmission is >0%.

The control system is preferably arranged and adapted to adjust the attenuation factor of the attenuation device by adjusting the mark space ratio $\Delta T_2/\Delta T_1$ in order to adjust or vary the transmission or attenuation of the attenuation device.

The control system is preferably arranged and adapted to switch between the first mode of operation and the second mode of operation with a frequency of: (i) <1 Hz; (ii) 1-10 Hz; (iii) 10-50 Hz; (iv) 50-100 Hz; (v) 100-200 Hz; (vi) 200-300 Hz; (vii) 300-400 Hz; (viii) 400-500 Hz; (ix) 500-600 Hz; (x) 600-700 Hz; (xi) 700-800 Hz; (xii) 800-900 Hz; (xiii) 900-1000 Hz; (xiv) 1-2 kHz; (xv) 2-3 kHz; (xvi) 3-4 kHz; (xvii) 4-5 kHz; (xviii) 5-6 kHz; (xix) 6-7 kHz; (xx) 7-8 kHz; (xxi) 8-9 kHz; (xxii) 9-10 kHz; (xxiii) 10-15 kHz; (xxiv) 15-20 kHz; (xxv) 20-25 kHz; (xxvi) 25-30 kHz; (xxvii) 30-35 kHz; (xxviii) 35-40 kHz; (xxix) 40-45 kHz; (xxx) 45-50 kHz; and (xxxi) >50 kHz.

According to an embodiment $\Delta T_1 > \Delta T_2$. According to another embodiment $\Delta T_1 \leq \Delta T_2$.

The time period $\Delta T_1$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

The time period $\Delta T_2$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

The attenuation device preferably comprises one or more electrostatic lenses.

In the first mode of operation the control system preferably causes a voltage to be applied to one or more electrodes of the attenuation device, wherein the voltage causes an electric field to be generated which acts to retard and/or deflect and/or reflect and/or divert a beam of ions.

The control system is preferably arranged and adapted to adjust the attenuation factor of the attenuation device by controlling the intensity of ions which are onwardly transmitted by the attenuation device by repeatedly switching the attenuation device ON and OFF, wherein the duty cycle of the attenuation device may be varied in order to control the degree of attenuation of the ions.

According to another aspect of the present invention there is provided a method of mass spectrometry comprising:

separating or filtering ions according to a first physico-chemical property;

separating or filtering ions according to a second physico-chemical property; and controlling or altering the intensity of ions having a first physico-chemical property within a first range and a second physico-chemical property within a second range so as to avoid saturation of an ion detector or other component of a mass spectrometer.

The first physico-chemical property preferably comprises ion mobility or differential ion mobility.

The second physico-chemical property preferably comprises mass, mass to charge ratio or time of flight.

The first and/or the second physico-chemical property preferably comprise mass, mass to charge ratio, time of flight, ion mobility, differential ion mobility, retention time, liquid chromatography retention time, gas chromatography retention time or capillary electrophoresis retention time.

The step of controlling or altering the intensity of ions having a first physico-chemical property within a first range and a second physico-chemical property within a second range preferably comprises: (i) controlling the attenuation factor of an attenuation lens; (ii) adjusting the gain of an ion detection system; (iii) adjusting the transmission of a mass spectrometer; (iv) adjusting the ionisation efficiency of an ion source; (v) adjusting the extent of fragmentation or reaction of ions within the mass spectrometer; or (vi) adjusting the duty cycle of the mass spectrometer.

The method preferably further comprises scaling the intensity of mass spectral data dependent upon the degree to which the intensity of ions having a first physico-chemical property within a first range and a second physico-chemical property within a second range are controlled or altered.

The method preferably further comprises separating or filtering ions according to a third physico-chemical property and wherein the step of controlling or altering the intensity of ions further comprises controlling or altering the intensity of ions having a first physico-chemical property within a first range, a second physico-chemical property within a second range and a third physico-chemical property within a third range so as to avoid saturation of the ion detector or other component of a mass spectrometer.

According to another aspect of the present invention there is provided a mass spectrometer comprising:

a first device for separating or filtering ions according to a first physico-chemical property;

a second device for separating or filtering ions according to a second physico-chemical property;

an ion detector; and a control system arranged and adapted:

(i) to control or alter the intensity of ions having a first physico-chemical property within a first range and a second physico-chemical property within a second range so as to avoid saturation of the ion detector or other component of a mass spectrometer.

The first device preferably comprises an ion mobility or differential ion mobility separator or filter.

The second device preferably comprises a mass, mass to charge ratio or time of flight separator or filter.

The first and/or the second device preferably comprises a mass, mass to charge ratio, time of flight, ion mobility, differential ion mobility, retention time, liquid chromatography retention time, gas chromatography retention time or capillary electrophoresis retention time separator or filter.

The control system is preferably arranged and adapted to control or alter the intensity of ions having a first physico-chemical property within a first range and a second physico-chemical property within a second range by: (i) controlling the attenuation factor of an attenuation lens; (ii) adjusting the gain of an ion detection system; (iii) adjusting the transmission of the mass spectrometer; (iv) adjusting the ionisation efficiency of an ion source; (v) adjusting the extent of fragmentation or reaction of ions within the mass spectrometer; or (vi) adjusting the duty cycle of the mass spectrometer.

The control system is preferably arranged and adapted to scale the intensity of mass spectral data dependent upon the degree to which the intensity of ions having a first physico-chemical property within a first range and a second physico-chemical property within a second range is controlled or altered.

The mass spectrometer preferably further comprises a third device for separating or filtering ions according to a third physico-chemical property and wherein the control system is arranged and adapted to control or alter the intensity of ions having a first physico-chemical property within a first range, a second physico-chemical property within a second range and a third physico-chemical property within a third range so as to avoid saturation of the ion detector or other component of a mass spectrometer.

According to another aspect of the present invention there is provided a method of mass spectrometry comprising:

separating or filtering ions according to at least first and second properties; and controlling or altering the intensity of ions having specific first and second properties so that a component of a mass spectrometer operates within a desired dynamic range.

The component preferably comprises an ion source, mass analyser or ion detection system.

According to another aspect of the present invention there is provided a mass spectrometer comprising:

devices arranged and adapted to separate or filter ions according to at least first and second properties; and a control system arranged and adapted to control or alter the intensity of ions having specific first and second properties so that a component of a mass spectrometer operates within a desired dynamic range.

The component preferably comprises an ion source, mass analyser or ion detection system.

According to another aspect of the present invention there is provided a method of mass spectrometry comprising:

obtaining a multi-dimensional array of data;

determining the most intense ion peak within a subset of the multi-dimensional array of data and increasing or reducing the intensity of ions or the gain of an ion detector accordingly; and then scaling the intensity of subsequent multi-dimensional data based upon the degree to which the intensity of ions or the gain of an ion detector was increased or reduced.

According to another aspect of the present invention there is provided a mass spectrometer comprising:

a control system arranged and adapted:

(i) to obtain a multi-dimensional array of data;

(ii) to determine the most intense ion peak within a subset of the multi-dimensional array of data and to increase or reduce the intensity of ions or the gain of an ion detector accordingly; and then (iii) to scale the intensity of subsequent multi-dimensional data based upon the degree to which the intensity of ions or the gain of an ion detector was increased or reduced.

According to an aspect of the present invention there is provided a method of extending the dynamic range of a mass spectrometer by:

(i) collecting a multi dimensional array or plurality of arrays of data in which ions have been separated in or by more than one substantially orthogonal separation method within a first time period;

(ii) based on the intensity of the signal in a predetermined region or regions of the array and/or plurality of preceding arrays, determining if the operating parameters of the mass spectrometer need to be adjusted to alter the intensity of signal;

(iii) adjusting the operating parameters of the mass spectrometer such that signal intensity within a second time period is changed such that the largest signal within the predetermined range or ranges remains within the dynamic range of the detector or data recording system during the acquisition of data in a second subsequent time period; and (iv) scaling the intensity of the subsequent multi dimensional array of data based on the known change or state of the operating parameters of the mass spectrometer.

In the preferred embodiment the multidimensional array comprises a two dimensional array of data where the first dimension of separation is mass to charge ratio and the second dimension is ion mobility drift time ("DT").

The operating parameters may be adjusted such that the intensity of the largest peak is reduced (or increased) such that the intensity stays within the dynamic range of the ion detection system.

The operating parameter is preferably an attenuation lens arranged upstream of the ion detector such that the transmission of the mass spectrometer or of ions to the ion detector is adjusted based on the intensity of peaks within a predetermined or targeted region of the mass to charge ratio and/or drift time array.

However, other operating parameters may be adjusted to give the same effect. For example, the gain of the ion detector or the ionisation efficiency of the ion source or the collision energy may all be used to adjust intensity.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred embodiment of the invention will now be described with reference to the following figures.

Figure 1:
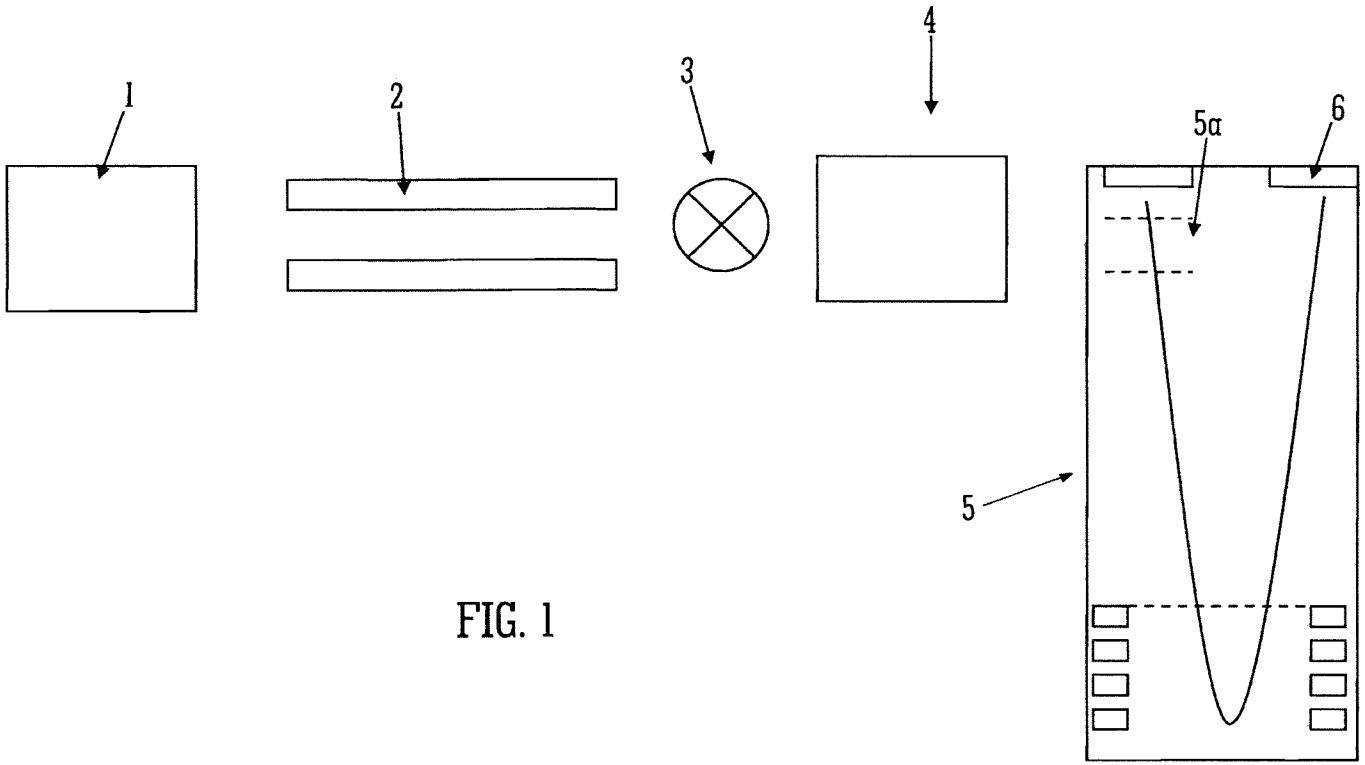
FIG. 1 shows a quadrupole-ion mobility spectrometer-Time of Flight mass spectrometer according to an embodiment of the present invention.

FIG. 1 shows a schematic of a quadrupole-ion mobility-Time of Flight mass spectrometer according to an embodiment of the present invention. Analyte is introduced via an inlet such as gas chromatography or liquid chromatography device and is ionised in an ion source 1. The ions may then be mass selectively filtered or non mass selectively onwardly transmitted by a quadrupole mass filter 2 to an ion mobility separator 4 which is preferably arranged downstream of the quadrupole mass filter 2. The ions are then preferably separated according to their ion mobility in the ion mobility separator 4. The ions are then onwardly transmitted to be mass analysed by an orthogonal acceleration Time of Flight mass analyser 5. The Time of Flight mass analyser 5 comprises an orthogonal acceleration region 5*a*, a reflectron and an ion detector 6.

Ion mobility separations are preferably performed within the ion mobility spectrometer 4 on a timescale of tens of milliseconds (ms) compared with the elution of a LC peak on a timescale of 1-2 seconds. The ion mobility spectrometer 4 coupled with the inherently fast acquisition rate of the Time of Flight mass analyser 5 allows nested LC-IMS-MS data to be acquired. In these experiments several two dimensional IMS-MS data sets may be acquired during the elution of a chromatographic peak.

An attenuation lens 3 is preferably provided intermediate the quadrupole mass filter 2 and the ion mobility spectrometer 4 as shown in FIG. 1. According to an embodiment the attenuation lens may comprise an attenuation lens 3 such as described in U.S. Pat. No. 7,683,314 (the contents of which are incorporated herein by reference) and which is preferably capable of adjusting the onward transmission of all ions through the mass spectrometer substantially equally and substantially irrespective of their mass to charge ratio. In particular, the attenuation lens 3 may be operated to ensure that the ion detector system 6 remains within a desired dynamic range and is not saturated by an intense packet of analyte ions of interest.

The ion detection system 6 of the Time of Fight mass analyser 5 preferably comprises an electron multiplier such as a microchannel plate and a fast digitiser such as a Time to Digital Converter or an Analog to Digital Converter. For all these detection systems 6 there is a finite maximum intensity of ion current which can be recorded before the dynamic range of the ion detection system 6 is exceeded.

The attenuation lens 3 preferably forms part of a control loop in which the output of the ion detection system 6 is compared with a predetermined maximum threshold. The attenuation lens 3 is then preferably adjusted to ensure that subsequent data recorded by the ion detection system 6 does not exceed the maximum threshold.

Figure 2:
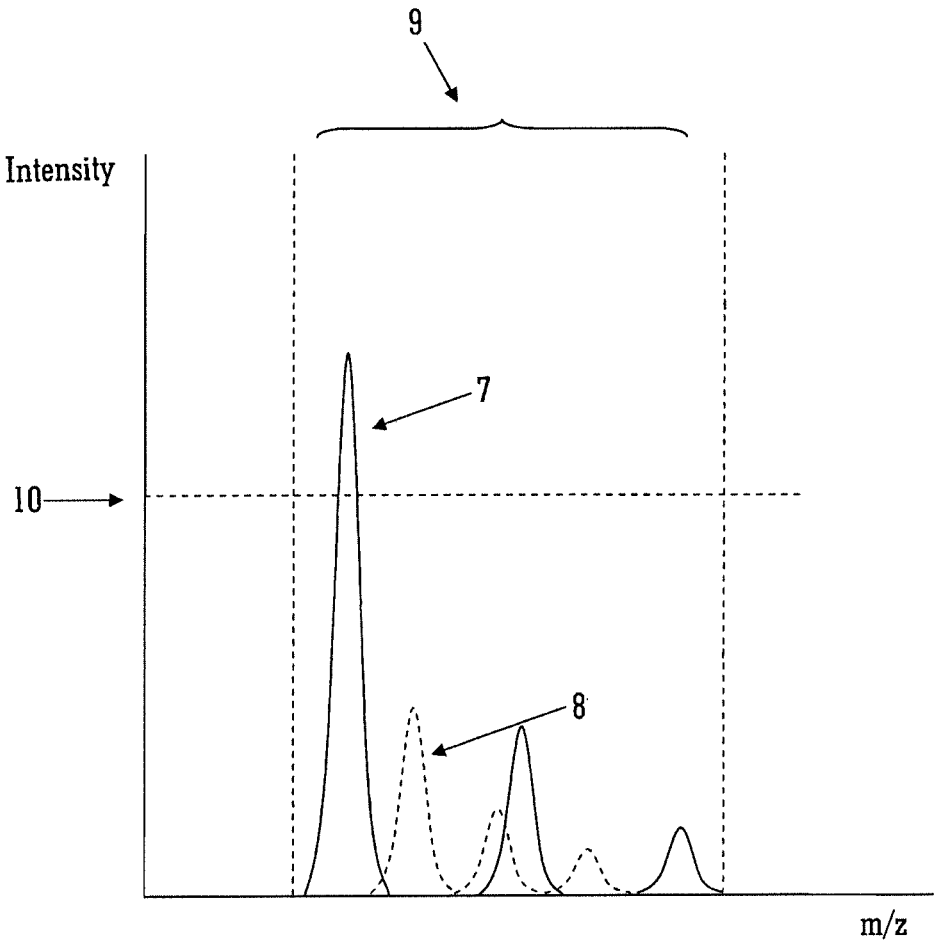
FIG. 2 PRIOR ART
FIG. 2 shows a region of interest of a mass spectrum and illustrates a conventional method of attenuating an ion beam to ensure that the ion detector is not saturated.

FIG. 2 shows a region of a typical mass spectrum and illustrates the conventional method of attenuating an ion beam in order to prevent ion detector saturation. A mass to charge ratio region 9 of interest has been selected as the region in which the signal intensity recorded by the ion detection system is compared to a maximum threshold intensity 10 which if exceeded will trigger the attenuation device 3 to reduce the ion transmission for acquisition of the next spectra. In this example there are two isotope distributions within this window namely a large (intense) singly charged ion species 7 and a smaller (less intense) multiply charged ion species 8.

In this example the smaller doubly charged ion 8 is the targeted analyte of interest. As both the large singly charged ion 7 and the smaller multiply charged ion 8 are in the mass to charge ratio window 9 simultaneously, the response from the larger signal 7 will trigger the control loop to adjust the transmission as the intensity exceeds the threshold 10. In some cases this could cause the smaller doubly charged ion species 8 to fall below the detection limit of the system.

Figure 3:
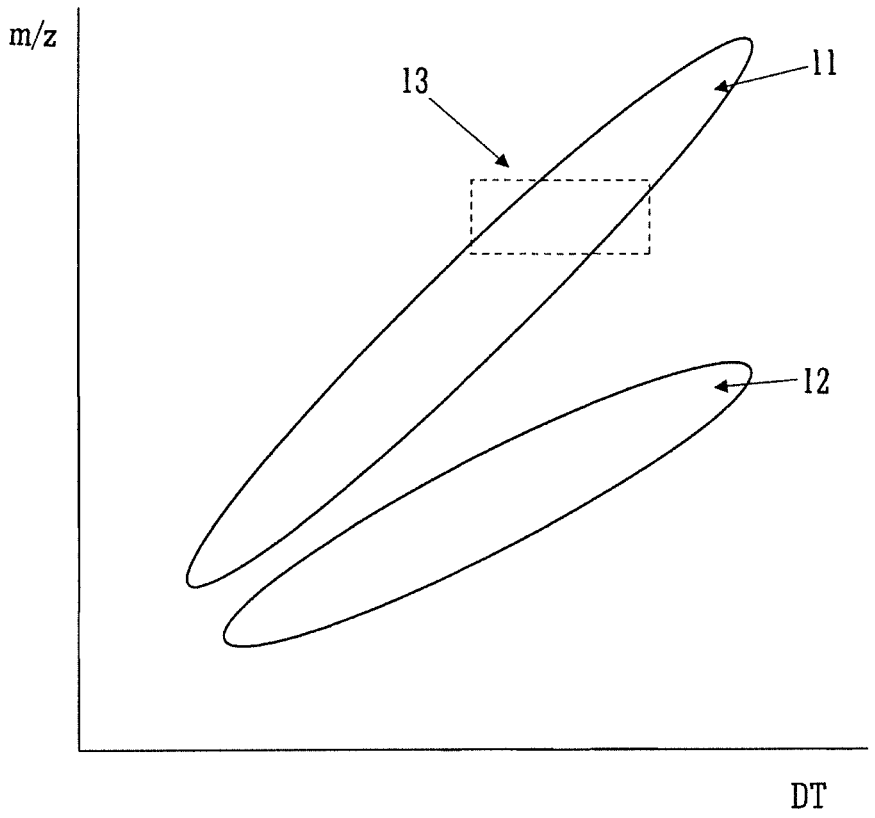
FIG. 3 shows a two dimensional plot of mass to charge ratio versus drift time and shows a region where singly charged ions are present and a region where multiply charged ions are present.

FIG. 3 shows a stylized mass to charge ratio versus ion mobility drift time plot and shows areas where singly charged ions 12 and doubly charged ions 11 fall within this two dimensional space. For illustrative purposes, a region 13 has been highlighted in FIG. 13 and is assumed to relate to a region of mass to charge ratio-ion mobility data in which only the doubly charged species 8 of interest as shown in FIG. 2 is present.

Figure 4:
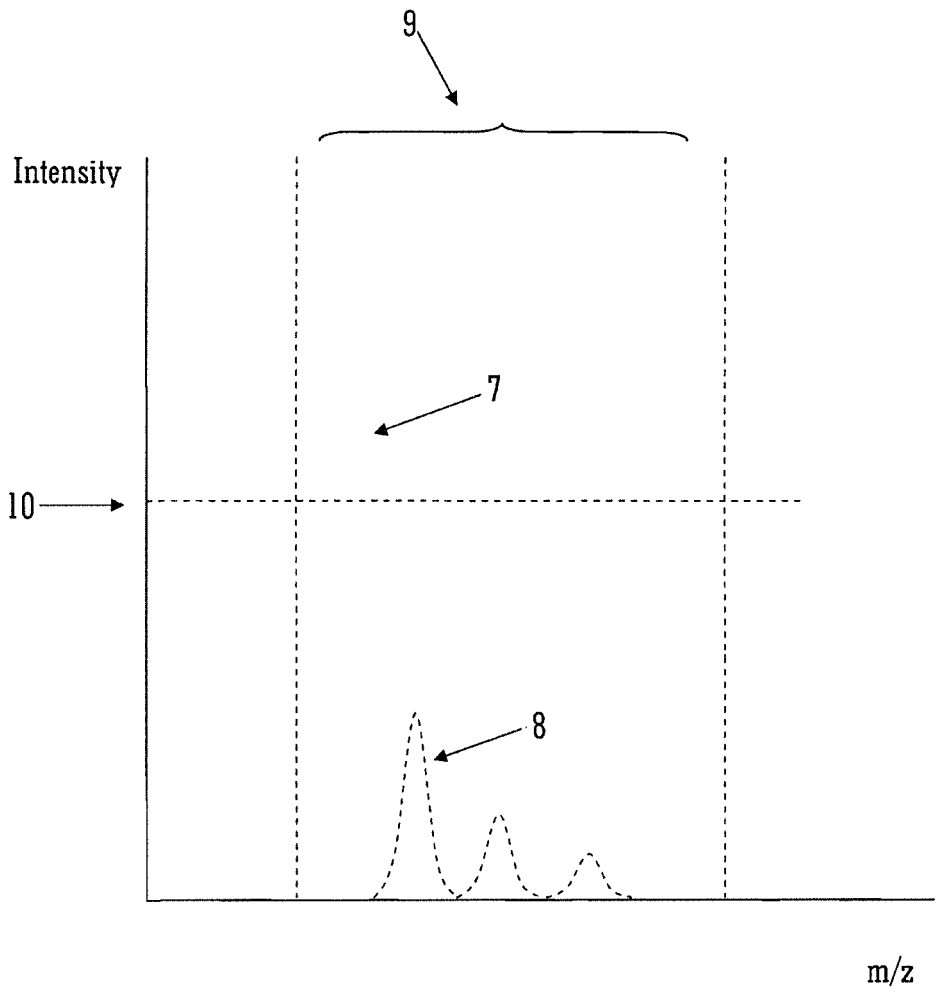
FIG. 4 shows a mass spectrum relating just to multiply charged ions of interest within a particular mass range.

FIG. 4 shows a mass spectrum relating just to the region of interest 13 as shown in FIG. 3 with the ion mobility dimension collapsed. According to an embodiment of the present invention the region 13 corresponds with just the doubly charged species 8 of interest and is preferably used to control the attenuation lens 3. As a result, target ions or interest are kept within the dynamic range of the ion detection system.

It should be noted that the singly charged ion 7 as shown in FIG. 2 will not be actively kept below the dynamic range of the ion detection system 6 and may therefore be distorted. However, as the singly charged ions 7 are not of interest this should not cause any problem to the analysis.

Figure 5:
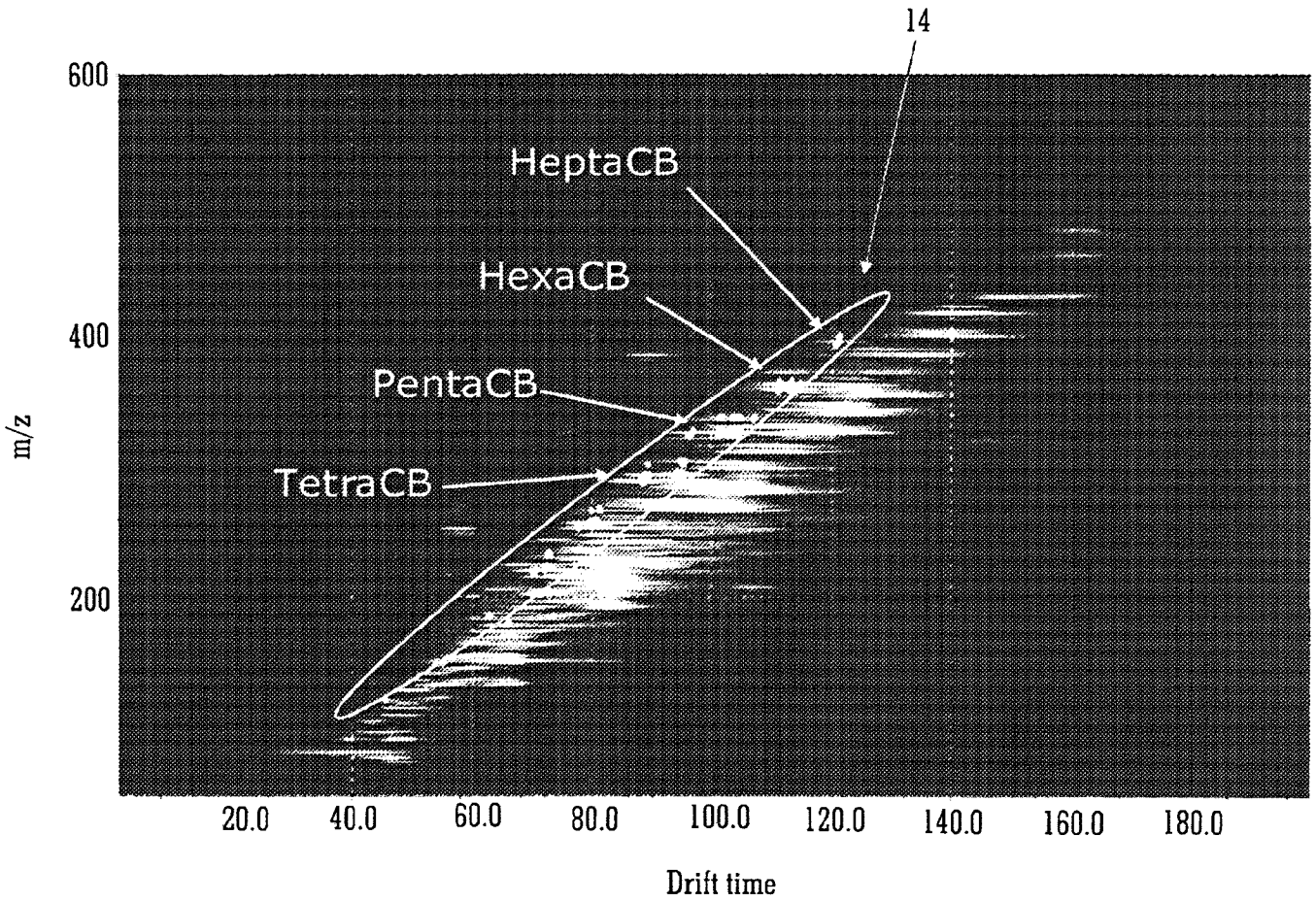
FIG. 5 shows a plot of mass to charge ratio versus ion mobility drift time for a standard mixture of poly chlorinated biphenols ("PCB")

A second illustration of the invention is shown in FIG. 5. FIG. 5 shows a plot of mass to charge ratio versus drift time plot for a GC-IMS-MS analysis of 80 pg of a standard mixture of poly chlorinated biphenols ("PCB"). It can be seen that the PCB molecular ions sit in a distinct region of the two dimensional data set. Selection of band 14 as illustrated in FIG. 5 as the region of data used to control the attenuation lens 3 will therefore advantageously exclude a large amount of background ions from the control of the attenuation lens 3 which would otherwise make control of the signal intensity for this group of compounds unreliable.

Figure 6:
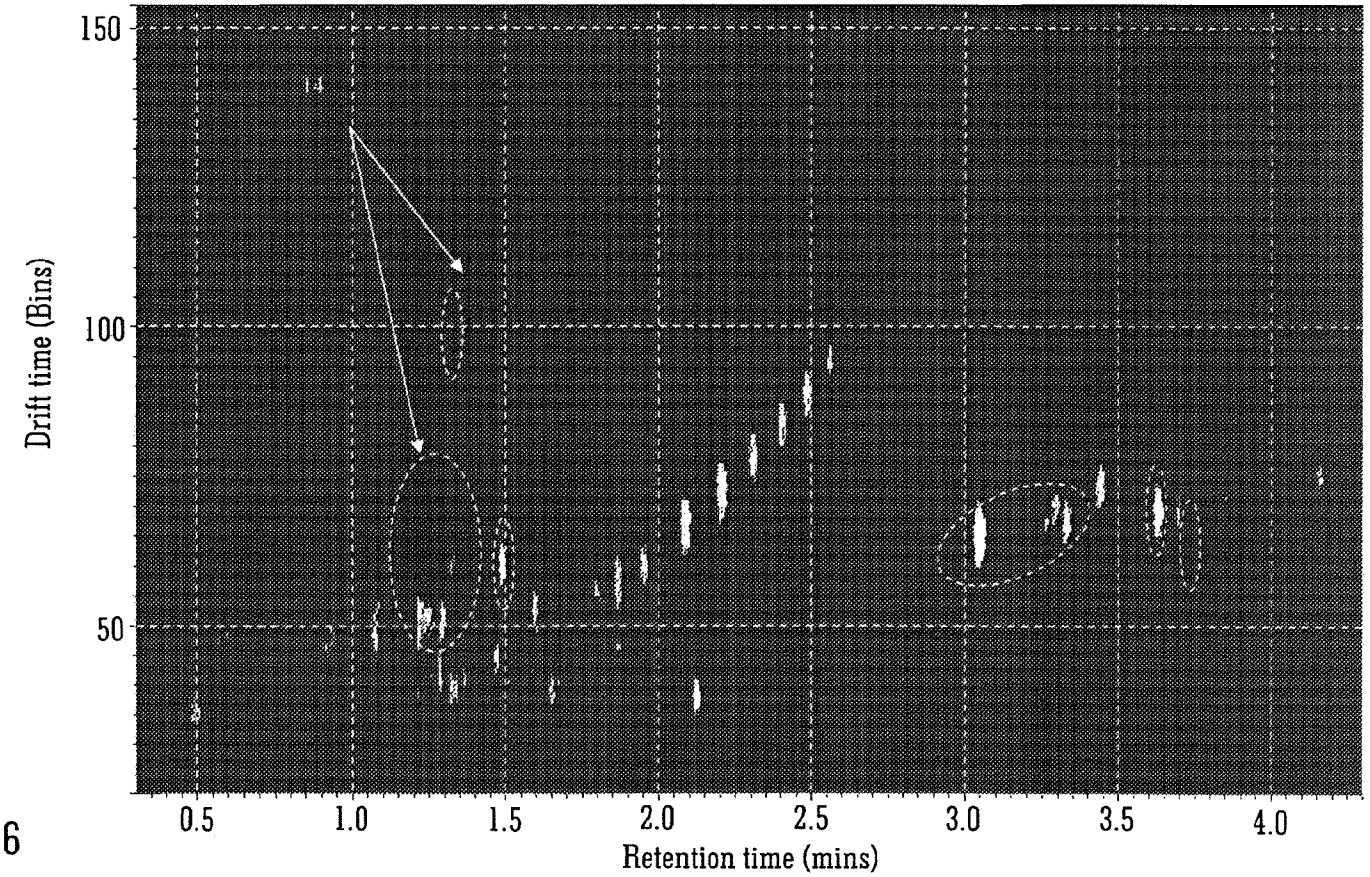
FIG. 6 shows a plot of ion mobility drift time versus liquid chromatography retention time for the analysis of metabolites of paracetamol in urine.

FIG. 6 shows a plot of ion mobility drift time versus liquid chromatography retention time for the analysis of the metabolites of paracetamol in urine. For illustration, the regions highlighted represent scheduled drift time-retention time areas which may be used to control the attenuation lens 3. Signal in other areas of the chromatogram may remain unattenuated or revert to attenuation control based on the largest peak in the entire two dimensional data set. Although not shown, each marked area may also be restricted in mass to charge ratio in order to add further specificity.

In all the examples shown once the amount of attenuation at a given time is known the intensity of the recorded data may be scaled accordingly to give a representation of the flux of ions prior to attenuation. In this way the maximum dynamic range of the system is extended for the targeted ions.

Figure 7:
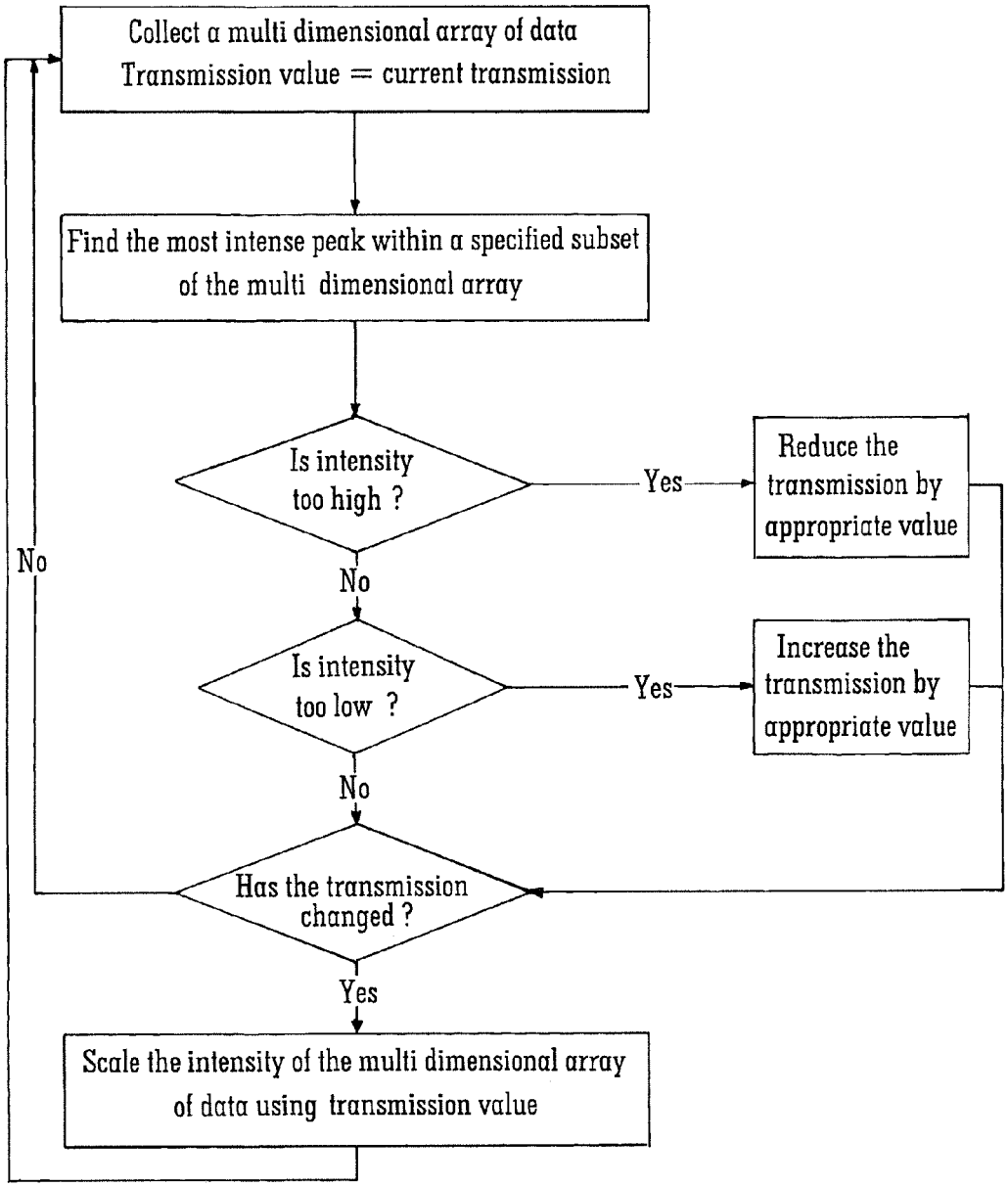
FIG. 7 shows a flow diagram illustrating aspects of a preferred method of the present invention.

FIG. 7 shows a basic flow diagram describing a preferred embodiment of the present invention. Although the flow diagram refers to controlling the intensity by reducing the transmission of ions through the mass spectrometer other methods of varying or controlling the intensity may be utilised.

Various different approaches to data dependent intensity control may be utilised. For example, two intensity thresholds may be set such that if the upper threshold is exceeded the intensity of the signal is lowered by a fixed amount until the signal falls below the lower threshold at which point the intensity is increased by a fixed amount. This dual threshold method introduces a level of hysteresis into the feedback control in an effort to minimize instability in the control loop.

Another preferred method is to use a form of proportional control i.e. a proportional-integral-derivative controller ("PID"). Specifically, the rate of change of intensity may be monitored within a given target region. The attenuation value applied may then be calculated by comparing the rate of change in intensity over two or more previous data sets and calculating a predicted attenuation value based on the predicted intensity value. To limit possible instability of this proportional derivative control due to noise a fixed upper and lower limit on the maximum and minimum change in attenuation factor for an individual adjustment may be applied. This allows the maximum rate of change of attenuation to be matched to the expected maximum rate of change of a chromatographic peak for example. This approach also ensures that the preferred feedback control does not oscillate and become unstable when small changes in intensity occur.

Other methods of closed loop proportional control may also be utilised.

Calculation of the attenuation value for a spectrum may be from a short non-storage pre-scan rather than from previously acquired data.

According to an embodiment the preferred method may also be applied to combinations of separators and scanning filters. For example a two dimensional array of data may be created by scanning a resolving quadrupole set mass, fragmenting the transmitted ions in a fragmentation or reaction cell and then acquiring time of flight mass spectra at a rate such that the spectral peaks recorded during the quadrupole scan are sampled repeatedly or profiled by the Time of Flight mass spectrometer. In this case one dimension of separation is mass to charge ratio filtering and the other is MS-MS mass time of flight separation. This produces a 2D array of data as the fragment ion mass to charge ratio values are orthogonal to the precursor mass to charge ratio values in the first dimension. A region of this data (e.g. corresponding to a constant neutral loss common to several precursors ions) may be selected to perform the data dependent intensity control.

One example comprises a Field Asymmetric Ion Mobility Spectrometer ("FAIMS") filter coupled with a time of flight separator. Another example comprises a Differential Mobility Analyser ("DMA") or ion mobility spectrometer or separator ("IMS") filter coupled with time of flight mass spectrometer ("MS"). Another example comprises an ion mobility spectrometer or separator coupled with a Field Asymmetric Ion Mobility Spectrometer ("FAIMS") filter or device. Another example comprises mass selective ejection from an ion trap coupled with time of flight mass spectrometer. Another example comprises chromatography coupled to the above described two stage separations. A yet further example comprises multi dimensional chromatography data e.g. GCxGC, LCxLC or LCxCE.

According to less preferred embodiments control of intensity may be made by adjusting the gain of the ion detection system. According to an embodiment control of intensity may be made by adjusting the transmission of the mass spectrometer. According to an embodiment control of intensity may be made by adjusting the ionisation efficiency of the ion source. According to an embodiment control of intensity may be made by adjusting the extent of fragmentation of ions within the mass spectrometer. According to a yet further embodiment control of intensity may be made by adjusting the duty cycle of the mass spectrometer.

Feedback may be performed on the total ion current within the array of data targeted rather than on the most intense peak.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

setting an ionisation efficiency of an ion source to a first value or setting an attenuation factor of an attenuation device to a first value or setting a gain of an ion detector or ion detection system to a first value; and then separating or filtering ions according to a first physico-chemical property and separating or filtering ions according to a second physico-chemical property and obtaining a multi-dimensional array of data;

determining the most intense ion peak within one or more subsets of said multi-dimensional array of data; and determining whether or not said most intense ion peak would cause saturation of an ion detector or an ion detection system or would otherwise adversely affect the operation of said ion detector or ion detection system;

wherein if it is determined that said most intense ion peak would cause saturation of said ion detector or ion detection system or would otherwise adversely affect the operation of said ion detector or ion detection system then said method further comprises:

(i) adjusting said ionisation efficiency of said ion source to a second value or adjusting said attenuation factor of said attenuation device to a second value or adjusting said gain of said ion detector or ion detection system to a second value;

(ii) obtaining mass spectral data wherein the adjustment of said ionisation efficiency of said ion source or the adjustment of said attenuation factor of said attenuation device or the adjustment of said gain of said ion detector or ion detection system alters the intensity of substantially all ions which are detected by said ion detector or ion detection system substantially equally and substantially irrespective of the mass to charge ratio of said ions; and then (iii) scaling the intensity of said mass spectral data based upon the degree to which said ionisation efficiency of said ion source or said attenuation factor of said attenuation device or said gain of said ion detector or ion detection system was increased or reduced.

2. A method as claimed in claim 1, wherein said first physico-chemical property comprises ion mobility or differential ion mobility.

3. A method as claimed in claim 1, wherein said second physico-chemical property comprises mass, mass to charge ratio or time of flight.

4. A method as claimed in claim 1, wherein said first or said second physico-chemical property comprise mass, mass to charge ratio, time of flight, ion mobility, differential ion mobility, retention time, liquid chromatography retention time, gas chromatography retention time or capillary electrophoresis retention time.

5. A method as claimed in claim 1, wherein the step of adjusting an attenuation factor of an attenuation device comprises repeatedly switching an attenuation device between a first mode of operation for a time period $\Delta T_1$ wherein the ion transmission is substantially 0% and a second mode of operation for a time period $\Delta T_2$ wherein the ion transmission is >0%.

6. A method as claimed in claimed in claim 5, wherein the step of adjusting said attenuation factor of said attenuation device comprises adjusting a mark space ratio $\Delta T_2/\Delta T_1$ in order to adjust or vary the transmission or attenuation of said attenuation device.

7. A method as claimed in claim 5, further comprising switching between said first mode of operation and said second mode of operation with a frequency of: (i) <1 Hz; (ii) 1-10 Hz; (iii) 10-50 Hz; (iv) 50-100 Hz; (v) 100-200 Hz; (vi) 200-300 Hz; (vii) 300-400 Hz; (viii) 400-500 Hz; (ix) 500-600 Hz; (x) 600-700 Hz; (xi) 700-800 Hz; (xii) 800-900 Hz; (xiii) 900-1000 Hz; (xiv) 1-2 kHz; (xv) 2-3 kHz; (xvi) 3-4 kHz; (xvii) 4-5 kHz; (xviii) 5-6 kHz; (xix) 6-7 kHz; (xx) 7-8 kHz; (xxi) 8-9 kHz; (xxii) 9-10 kHz; (xxiii) 10-15 kHz; (xxiv) 15-20 kHz; (xxv) 20-25 kHz; (xxvi) 25-30 kHz; (xxvii) 30-35 kHz; (xxviii) 35-40 kHz; (xxix) 40-45 kHz; (xxx) 45-50 kHz; and (xxxi) >50 kHz.

8. A method as claimed in claim 5, wherein $\Delta T_1 > \Delta T_2$.

9. A method as claimed in claim 5, wherein $\Delta T_1 < \Delta T_2$.

10. A method as claimed in claim 5, wherein said time period $\Delta T_1$ is selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

11. A method as claimed in claim 5, wherein said time period $\Delta T_2$ is selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

12. A method as claimed in claim 5, wherein in said first mode of operation a voltage is applied to one or more electrodes of said attenuation device, wherein said voltage causes an electric field to be generated which acts to retard or deflect or reflect or divert a beam of ions.

13. A method as claimed in claim 1, wherein said attenuation device comprises one or more electrostatic lenses.

14. A method as claimed in claim 1, wherein said step of adjusting the attenuation factor of said attenuation device comprises controlling the intensity of ions which are onwardly transmitted by said attenuation device by repeatedly switching said attenuation device ON and OFF, wherein a duty cycle of said attenuation device may be varied in order to control the degree of attenuation of said ions.

15. A mass spectrometer comprising:

a first device for separating or filtering ions according to a first physico-chemical property;

a second device for separating or filtering ions according to a second physico-chemical property;

an ion detector or ion detection system; and a control system arranged and adapted:

(i) to set an ionisation efficiency of an ion source to a first value or to set an attenuation factor of an attenuation device to a first value or to set a gain of said ion detector or ion detection system to a first value; and then (ii) to cause ions to separate or be filtered according to said first physico-chemical property in said first device and to cause ions to separate or be filtered according to said second physico-chemical property and to obtain a multi-dimensional array of data;

(iii) to determine the most intense ion peak within one or more subsets of said multi-dimensional array of data; and (iv) to determine whether or not said most intense ion peak would cause saturation of said ion detector or said ion detection system or would otherwise adversely affect the operation of said ion detector or ion detection system;

wherein if it is determined that said most intense ion peak would cause saturation of said ion detector or ion detection system or would otherwise adversely affect the operation of said ion detector or ion detection system then said control system is further arranged and adapted:

(v) to adjust said ionisation efficiency of said ion source to a second value or to adjust said attenuation factor of said attenuation device to a second value or to adjust said gain of said ion detector or ion detection system to a second value;

(vi) to obtain mass spectral data wherein the adjustment of said ionisation efficiency of said ion source or the adjustment of said attenuation factor of said attenuation device or the adjustment of said gain of said ion detector or ion detection system alters the intensity of substantially all ions which are detected by said ion detector or ion detection system substantially equally and substantially irrespective of the mass to charge ratio of said ions; and then (vii) to scale the intensity of said mass spectral data based upon the degree to which said ionisation efficiency of said ion source or said attenuation factor of said attenuation device or said gain of said ion detector or ion detection system was increased or reduced.

16. A mass spectrometer as claimed in claim 15, wherein said first device comprises an ion mobility or differential ion mobility separator or filter.

17. A mass spectrometer as claimed in claim 15, wherein said second device comprises a mass, mass to charge ratio or time of flight separator or filter.

18. A mass spectrometer as claimed in claim 15, wherein said first or said second device comprise a mass, mass to charge ratio, time of flight, ion mobility, differential ion mobility, retention time, liquid chromatography retention time, gas chromatography retention time or capillary electrophoresis retention time separator or filter.

19. A mass spectrometer as claimed in claim 15, wherein said control system is arranged and adapted to adjust an attenuation factor of said attenuation device by repeatedly switching said attenuation device between a first mode of operation for a time period $\Delta T_1$ wherein the ion transmission is substantially 0% and a second mode of operation for a time period $\Delta T_2$ wherein the ion transmission is >0%.

20. A mass spectrometer as claimed in claimed in claim 19, wherein said control system is arranged and adapted to adjust said attenuation factor of said attenuation device by adjusting the mark space ratio $\Delta T_2/\Delta T_1$ in order to adjust or vary the transmission or attenuation of said attenuation device.

21. A mass spectrometer as claimed in claim 19, wherein said control system is arranged and adapted to switch between said first mode of operation and said second mode of operation with a frequency of: (i) <1 Hz; (ii) 1-10 Hz; (iii) 10-50 Hz; (iv) 50-100 Hz; (v) 100-200 Hz; (vi) 200-300 Hz; (vii) 300-400 Hz; (viii) 400-500 Hz; (ix) 500-600 Hz; (x) 600-700 Hz; (xi) 700-800 Hz; (xii) 800-900 Hz; (xiii) 900-1000 Hz; (xiv) 1-2 kHz; (xv) 2-3 kHz; (xvi) 3-4 kHz; (xvii) 4-5 kHz; (xviii) 5-6 kHz; (xix) 6-7 kHz; (xx) 7-8 kHz; (xxi) 8-9 kHz; (xxii) 9-10 kHz; (xxiii) 10-15 kHz; (xxiv) 15-20 kHz; (xxv) 20-25 kHz; (xxvi) 25-30 kHz; (xxvii) 30-35 kHz; (xxviii) 35-40 kHz; (xxix) 40-45 kHz; (xxx) 45-50 kHz; and (xxxi) >50 kHz.

22. A mass spectrometer as claimed in claim 19, wherein $\Delta T_1 > \Delta T_2$.

23. A mass spectrometer as claimed in claim 19, wherein $\Delta T_1 \leq \Delta T_2$.

24. A mass spectrometer as claimed in claim 19, wherein said time period $\Delta T_1$ is selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

25. A mass spectrometer as claimed in claim 19, wherein said time period $\Delta T_2$ is selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; and (xxvii) >100 ms.

26. A mass spectrometer as claimed in claim 19, wherein in said first mode of operation said control system causes a voltage to be applied to one or more electrodes of said attenuation device, wherein said voltage causes an electric field to be generated which acts to retard or deflect or reflect or divert a beam of ions.

27. A mass spectrometer as claimed in claim 15, wherein said attenuation device comprises one or more electrostatic lenses.

28. A mass spectrometer as claimed in claim 15, wherein said control system is arranged and adapted to adjust the attenuation factor of said attenuation device by controlling the intensity of ions which are onwardly transmitted by said attenuation device by repeatedly switching said attenuation device ON and OFF, wherein a duty cycle of said attenuation device may be varied in order to control the degree of attenuation of said ions.

* * * * *